US011553778B2

(12) United States Patent
Trochel

(10) Patent No.: US 11,553,778 B2
(45) Date of Patent: Jan. 17, 2023

(54) COSMETIC PRODUCT DISPENSING DEVICE, COMPRISING A BASE AND A CARTRIDGE DESIGNED TO BE DETACHABLY INTERCOUPLED

(71) Applicant: AXILONE PLASTIQUE, Auray (FR)

(72) Inventor: Reynald Trochel, Plouharnel (FR)

(73) Assignee: AXILONE PLASTIQUE, Auray (FR)

( * ) Notice: Subject to any disclaimer, the term of this patent is extended or adjusted under 35 U.S.C. 154(b) by 302 days.

(21) Appl. No.: 16/772,088

(22) PCT Filed: Dec. 10, 2018

(86) PCT No.: PCT/FR2018/053167

§ 371 (c)(1),
(2) Date: Jun. 11, 2020

(87) PCT Pub. No.: WO2019/115922

PCT Pub. Date: Jun. 20, 2019

(65) Prior Publication Data

US 2021/0068517 A1 Mar. 11, 2021

(30) Foreign Application Priority Data

Dec. 12, 2017 (FR) ..... 17 62012

(51) Int. Cl.
*A45D 40/06* (2006.01)
*A45D 40/16* (2006.01)
*A45D 40/00* (2006.01)

(52) U.S. Cl.
CPC ..... *A45D 40/06* (2013.01); *A45D 40/16* (2013.01); *A45D 2040/005* (2013.01)

(58) Field of Classification Search
CPC ..... A45D 2040/0056; A45D 2040/005; A45D 40/16; A45D 40/06
See application file for complete search history.

(56) References Cited

U.S. PATENT DOCUMENTS 3,009,568 A * 11/1961 Bau ..... A45D 40/02 401/78
3,623,821 A 11/1971 Gould et al.
(Continued)

FOREIGN PATENT DOCUMENTS

CN 203234222 U 10/2013
FR 1118520 A 6/1956
(Continued)

OTHER PUBLICATIONS

Office Action issued in Korean Patent Application No. 10-2020-7019615 dated Aug. 30, 2021.
(Continued)

*Primary Examiner* — Patrick M. Buechner
(74) *Attorney, Agent, or Firm* — Nixon & Vanderhye

(57) ABSTRACT

A cosmetic product dispensing device includes a base and a tubular cartridge configured to be detachably coupled to the base. The cartridge includes: an outer tube; a control sleeve; a receptacle for cosmetic product; and a bottom element integral in rotation with the control sleeve. The base includes an operating member including a coded pattern and the bottom element includes a complementary operating member including a complementary coded pattern. The operating member is able to engage with the complementary operating member such that a relative rotation of the base in relation to the cartridge causes a movement of the receptacle for cosmetic product along a longitudinal axis of the cartridge.

20 Claims, 4 Drawing Sheets

(56) References Cited

U.S. PATENT DOCUMENTS

| | | | | |
|---|---|---|---|---|
| 3,758,218 | A * | 9/1973 | Pfrommer | A45D 40/06 401/86 |
| 4,505,607 | A * | 3/1985 | Sugiyama | A45D 40/06 401/98 |
| 4,666,324 | A * | 5/1987 | Oses | A45D 40/06 401/98 |
| 5,340,225 | A * | 8/1994 | Chevassus | A45D 40/06 401/86 |
| 5,605,408 | A | 2/1997 | Su | |
| 6,116,801 | A | 9/2000 | Patel et al. | |
| 6,293,391 | B1 | 9/2001 | Kim | |
| 8,556,527 | B1 | 10/2013 | Chou | |
| 10,881,184 | B1 | 1/2021 | Yan | |
| 2010/0078344 | A1 | 4/2010 | Martins et al. | |
| 2013/0022384 | A1 | 1/2013 | Yan | |
| 2013/0075301 | A1* | 3/2013 | McLaughlin | A45D 40/18 206/385 |
| 2017/0196339 | A1 | 7/2017 | Kim | |

FOREIGN PATENT DOCUMENTS

| | | | |
|---|---|---|---|
| FR | 2502471 | A1 | 10/1982 |
| FR | 2942115 | A1 | 8/2010 |
| GB | 2183220 | A | 6/1987 |
| JP | S57-155712 | U | 9/1982 |
| JP | S60173226 | U | 11/1985 |
| JP | S63-068917 | U | 5/1988 |
| JP | 2013-517017 | A | 5/2013 |
| JP | 2013-172888 | A | 9/2013 |
| KR | 10-2000-0012473 | A | 3/2000 |
| KR | 10-2004-0034228 | A | 4/2004 |
| WO | 2011/085511 | A1 | 7/2011 |
| WO | 2016/011631 | A1 | 1/2016 |

OTHER PUBLICATIONS

Office Action issued in Japanese Patent Application No. 2020-531914 dated Oct. 4, 2021.

Office Action issued in the co-pending U.S. Appl. No. 16/772,378 dated Sep. 30, 2021.

Office Action issued in the co-pending U.S. Appl. No. 16/772,347 dated Oct. 28, 2021.

Office Action issued in Japanese Patent Application No. 2020-531942 dated Oct. 11, 2021.

Office Action issued in Japanese Patent Application No. 2020-531907 dated Nov. 1, 2021.

French Search Report, dated Jun. 29, 2018, from French Application No. 1762013, cited in related U.S. Appl. No. 16/772,347.

French Search Report, dated Jul. 4, 2018, from French Application No. 1762015, cited in related U.S. Appl. No. 16/772,378.

International Search Report, dated Mar. 22, 2019, from PCT Application No. PCT/FR2018/053168, cited in related U.S. Appl. No. 16/772,347.

International Search Report, dated Mar. 29, 2019, from PCT Application No. PCT/FR2018/053169, cited in related U.S. Appl. No. 16/772,378.

International Search Report (ISR), dated Mar. 22, 2019, from corresponding International Application No. PCT/FR2018/053167.

French Search Report (FRSR), dated Jun. 26, 2018, from corresponding French Application No. FR 17 62012.

* cited by examiner

COSMETIC PRODUCT DISPENSING DEVICE, COMPRISING A BASE AND A CARTRIDGE DESIGNED TO BE DETACHABLY INTERCOUPLED

FIELD OF THE INVENTION

The invention relates to containers for cosmetic product. More specifically, the invention relates to cosmetic product dispensing devices which comprise a base and a cartridge configured to be detachably coupled to each other. The invention relates in particular to lipstick dispensing devices.

TECHNOLOGICAL BACKGROUND OF THE INVENTION

A cosmetic product dispensing device may comprise a base and a cartridge coupled to the base. This is often the case with lipstick dispensing devices. The cartridge thus serves to enclose a stick of lipstick and allow access to it. To achieve this, the cartridge comprises a receptacle for the stick of lipstick. The base has the particular function of making it possible to grip the lipstick dispensing device.

The cartridge and the base are arranged in succession along a longitudinal axis of the lipstick dispensing device. In addition, the cartridge and the base are coupled and are rotatable, relative to each other, about an axis of rotation corresponding to the longitudinal axis of the lipstick dispensing device. Thus, by causing a rotation of the base relative to the cartridge, it is possible to move the receptacle for the stick of lipstick along the longitudinal axis of the dispensing device.

Usually, the base and the cartridge are permanently coupled. When the stick of lipstick is consumed, it is therefore necessary to buy a new dispensing device.

To overcome the above disadvantage, dispensing devices have therefore been produced in which the base and the cartridge are detachably coupled. When the stick of lipstick is consumed, it is thus possible to separate the base and the cartridge and to replace only the cartridge, which is more ecological. In addition, a user may possess a single base and several cartridges corresponding to sticks of lipstick of different colors.

However, if a user possesses several bases and several cartridges, the user may inadvertently couple a base and a cartridge which are not intended to be coupled together. This results in a significant risk of damage to the base and/or the cartridge. For example, a base may be configured to accommodate a cartridge having a diameter of 12 millimeters. The user may couple this base with a cartridge having a different diameter, for example 13 millimeters, and thus jam the dispensing device.

OBJECT OF THE INVENTION

An aim of the invention is to provide a cosmetic product dispensing device that is more reliable.

BRIEF DESCRIPTION OF THE INVENTION

To achieve this, the invention provides a cosmetic product dispensing device comprising a base and a tubular cartridge configured to be detachably coupled to the base, the cartridge comprising:

- an outer tube comprising at least one helical groove,
- a control sleeve comprising at least one longitudinal guide slot,

- a receptacle for cosmetic product, engaging with the helical groove of the outer tube and the longitudinal guide slot of the control sleeve,
- a bottom element, integral in rotation with the control sleeve, characterized in that the base comprises an operating member comprising a three-dimensional coded pattern and the bottom element comprises an operating counterpart comprising a counterpart three-dimensional coded pattern such that the operating member is able to be coupled with the operating counterpart so that a relative rotation of the base in relation to the cartridge causes a movement of the receptacle for cosmetic product at least along a longitudinal axis of the cartridge, in that the bottom element comprises a ring of ferromagnetic material or a magnet configured to contribute to providing a retention force between the cartridge and the base when the cartridge is coupled to the base, and in that the bottom element is covered radially outward by the outer tube.

Thus, by appropriately shaping the three-dimensional coded pattern of the operating member and the three-dimensional coded pattern of the operating counterpart, a mechanical coded pattern is defined such that only a cartridge intended to engage with the base can be effectively coupled to said base. This prevents inadvertently coupling a cartridge and a base which are not intended to engage with each other. The cosmetic product dispensing device is therefore more reliable.

Advantageously, this arrangement also makes it possible to protect the cartridge when it is removed from the base and stored, for example in a users handbag. Here the term "protect" covers the practical impossibility of operating the control sleeve via a rotation of the bottom element when the cartridge is removed from the base. As the bottom element is covered radially outward by the outer tube, it is not possible to grasp it between two fingers in order to rotate the control sleeve; moreover, given the small diameter and the smoothness of the bottom element, it is very difficult or even impossible to rotate it even by inserting the little finger.

Also, the three-dimensional coded pattern prevents the bottom element from being manipulated by means of an instrument or tool of simple shape such as the end of a wrench or a small screwdriver.

As a result, once the cartridge has been removed from the base, the receptacle for cosmetic product remains in its current position and the cosmetic product is perfectly secure inside the cartridge.

In addition, in preferred embodiments of the invention, one or more of the following arrangements may possibly be used:

- The three-dimensional coded pattern and the counterpart three-dimensional coded pattern are each circumscribed within a cylinder having a diameter of less than 8 mm, preferably less than 7 mm, and even more preferably within a cylinder having a diameter of less than 6 mm. The three-dimensional coded pattern is preferably centered on the axis and occupies a very small volume which makes it possible to arrange the magnetic retention interface around it on the periphery of this three-dimensional pattern, all within a limited diameter of 16 mm or less,
- The three-dimensional coded pattern forms a male part and the counterpart three-dimensional coded pattern forms a female part; thus, even with a tool, it is not possible to catch hold of a shape in the bottom element in an attempt to rotate the control sleeve, The three-dimensional coded pattern forms a female part and the counterpart three-dimensional coded pattern forms a male part; thus, even with the help of a tool, even a pointed one, it is not possible to insert it into the bottom element in an attempt to rotate the control sleeve, The three-dimensional coded pattern of the operating member has a key shape, the counterpart three-dimensional coded pattern of the complementary operating counterpart having a lock shape; the technical effect is thus obtained in a simple and reliable manner because only a key shape corresponding to the lock shape of the operating counterpart enables the rotational coupling of the bottom element and the base;

One will note that the operating counterpart may or may not be strictly complementary to the operating member, The operating member comprises a seat and a coupling stud projecting from the seat; it is thus possible not to form a member projecting from the cartridge, which reduces the risk of unwanted operation of the cartridge;

The coupling stud is a pin; it is therefore easy to obtain by molding;

The operating counterpart comprises a portion, preferably flat, having at least one coupling groove and/or at least one coupling orifice and/or at least one coupling stud; as a result, the coded pattern and the counterpart coded pattern are easily identifiable by the user;

The outer tube has two opposite longitudinal ends, the bottom element being arranged between and at a distance from the two longitudinal ends of the outer tube; thus, when the cartridge is not coupled to the base, the bottom element is protected and there is no risk of it accidentally rotating, thereby driving the control sleeve;

The outer tube comprises a covering part which surrounds a technical part comprising the helical groove; thus, the helical groove and the covering part form the helical groove; in addition, the outer tube is easier to manufacture;

The receptacle for cosmetic product comprises at least one guide stud which passes through the longitudinal guide slot of the control sleeve and is arranged in the helical groove of the outer tube; this is a simple and reliable solution for moving the receptacle;

The guide stud is a pin; it is therefore easy to obtain by molding;

The cartridge has a first cylindrical portion and a second cylindrical portion arranged following the first cylindrical portion, the second cylindrical portion comprising the bottom element and having a diameter greater than the diameter of the first cylindrical portion; this prevents unwanted manipulation of the cartridge when it is, for example, at the bottom of a handbag;

The cosmetic product is a stick of lipstick;

The base may comprise a permanent magnet and the bottom element may comprise a ring of ferromagnetic material so as to provide a retention force between the cartridge and the base when the cartridge is coupled to the base. As the base is a valuable part of the case, it is preserved in the event of a cartridge change and therefore the permanent magnet is not thrown out with the cartridge, instead the permanent magnet is preserved in the base.

According to one option, in a configuration where the cartridge is assembled on the base, an interval representing an air gap (e) which separates the permanent magnet from the ring loaded with ferromagnetic elements is less than 0.5 mm and preferably less 0.2 mm. This provides strong magnetic retention and a high-quality appearance, and gives confidence to the user.

BRIEF DESCRIPTION OF DRAWINGS

We will now describe some embodiments of the invention as non-limiting examples, with the aid of the following figures.

DETAILED DESCRIPTION OF AN EMBODIMENT OF THE INVENTION

For clarity, only the elements useful in understanding the described embodiments have been shown and will be detailed.

It should be noted that in the figures, structural and/or functional elements common to the different embodiments have the same references. Thus, unless otherwise stated, such elements have identical structural, dimensional, and material properties. The scales of representation may vary from one figure to another.

Figure 1:
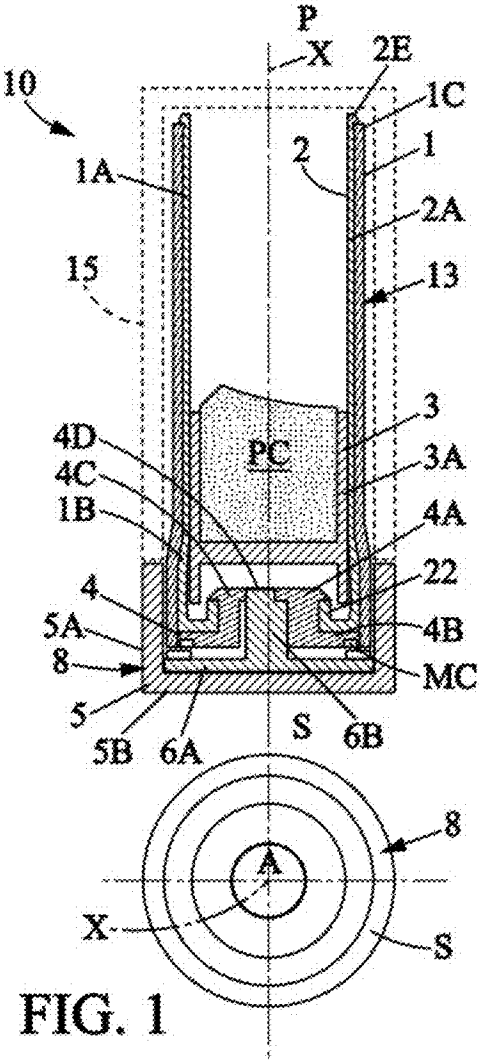
FIG. 1 illustrates a sectional view of a dispensing device in a plane comprising a longitudinal axis, according to one embodiment of the invention which comprises a cartridge, a base, and a cap, and also represents the base in a top view.
Figure 3:
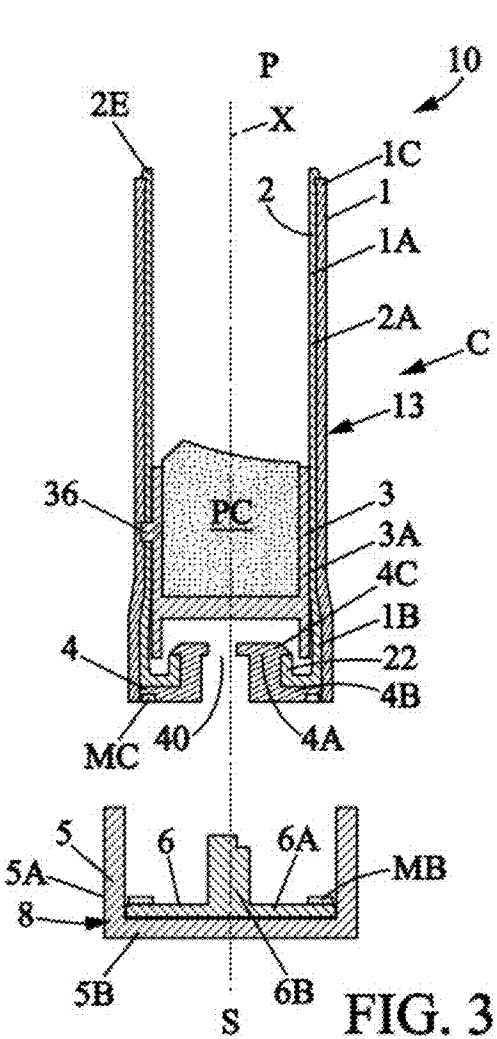
FIG. 3 represents the uncoupled base and cartridge, again in the sectional plane described above.
Figure 4:
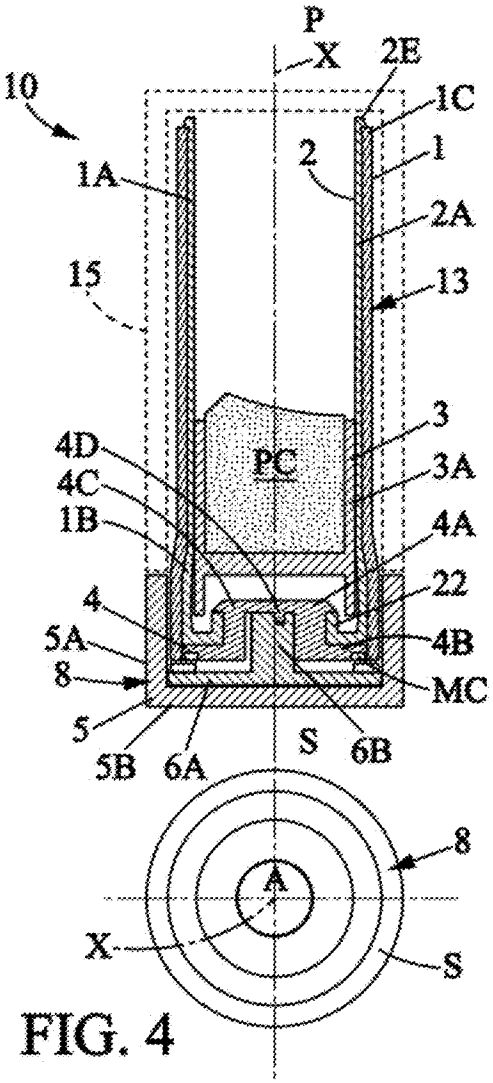
FIGS. 4 to 6 are respective views similar to FIGS. 1 to 3, of a dispensing device according to a second embodiment.
Figure 5:
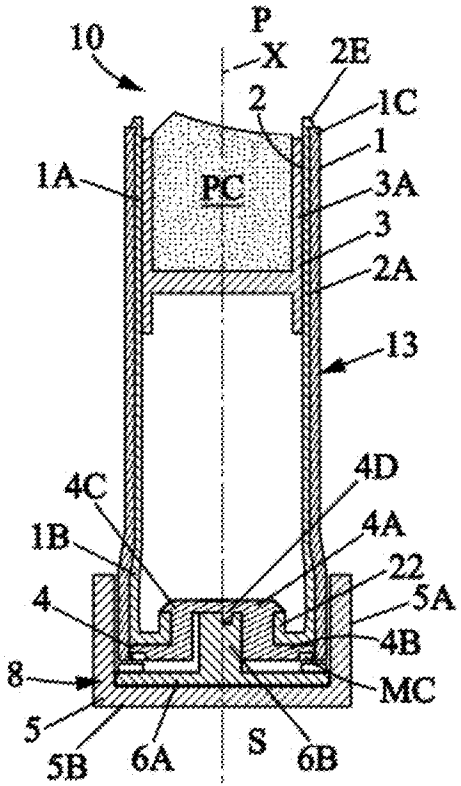
Figure 6:
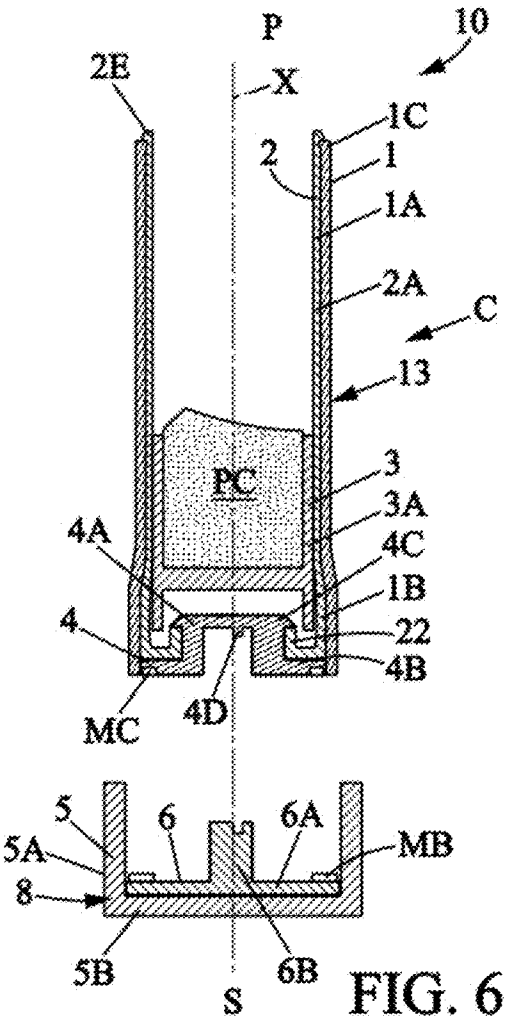

A cosmetic product dispensing device 10 according to the invention comprises a base 8, a cartridge 13, and optionally a cap 15 represented with phantom lines in FIGS. 1 and 4. The dispensing device 10 is represented with the aid of schematic diagrams, according to a first embodiment of the invention in FIGS. 1 to 3 and according to a second embodiment of the invention in FIGS. 4 to 6. FIGS. 7 to 10 relate to a third embodiment. FIG. 11 relates to a variant of the third embodiment. The cartridge 13 comprises an outer tube 1, a control sleeve 2, a receptacle 3 for the stick of lipstick PC, and a bottom element 4.

The base 8 and the cap 15 together form a decorative setting provided to enhance the cosmetic product dispensing device. The base and the cap may in particular have a highly aesthetic decoration, or even a decoration providing luxury customization.

In the embodiments described here, the dispensing device 10 is a lipstick case. It thus contains a stick of lipstick PC.

The stick of lipstick PC is in the form of a solid or semi-solid material, in particular pasty, and is applied by rubbing it on the lips of a user.

In addition, the dispensing device 10 has a generally cylindrical shape and has a longitudinal axis X. It extends between a first longitudinal end P and a second longitudinal end S. The second longitudinal end S of the dispensing device 10 is the one furthest from the user's lips when the user is applying the stick PC to the lips. In the following description, reference will also be made to first P and second S longitudinal ends, defined as above, when describing members of the dispensing device 10. In addition, the adjectives "inner" and "outer" will be used in relation to the interior and exterior respectively of the dispensing device 10. In addition, a midplane is defined as being a plane perpendicular to the longitudinal axis X.

The dispensing device 10 is able to be in a closed position, illustrated in FIGS. 1 and 4, in which the cap 15 is closing off access from a first longitudinal end P to the interior of the cartridge 13. The dispensing device 10 is also able to be in an open position, illustrated in FIGS. 2, 3 and 5, 6, in which the interior of the cartridge 13 is accessible from the first longitudinal end P.

One will note that the base 8 and the cap 15 are configured to cooperate, for example by magnetic or mechanical means, so that when the dispensing device 10 is in the closed position, the cartridge 13 is hidden from the exterior of the dispensing device 10, by the base 8 and cap 15.

Furthermore, the base 8 and the cartridge 13 may be detachably coupled as will be described in more detail below. The base 8 and the cartridge 13 are coupled in FIGS. 1, 2 and 4, 5. They are shown uncoupled in FIGS. 3 and 6.

Indeed, the user may for example wish to buy a replacement cartridge 13 when the stick of lipstick PC has been consumed. The user may also wish to keep, for example in a handbag, several cartridges 13 each containing a stick of lipstick PC of a different color. The user may also wish to use a specific base 8 and cap 15 to enclose the cartridge 13 in a certain situation, for example in a business setting, and use another base 8/cap 15 assembly to enclose the cartridge 13 in another situation, for example in a party setting.

Thus, there is a risk of the user coupling a base 8 and a cartridge 13 which are not configured to be coupled. For example, the base 8 may be shaped to accommodate a cartridge 13 having a diameter substantially equal to 12 millimeters. The user, not seeing the difference with the naked eye, could attempt to couple the base 8 to a cartridge 13 having a diameter of 13 millimeters and thus jam or damage the base 8 and/or the cartridge 13.

The base 8 has a generally cylindrical shape and comprises a protective shell 5 which forms an outer wall of the base 8. The protective shell 5 comprises a cylindrical wall 5A which extends along the longitudinal axis X. In addition, the protective shell 5 comprises a flat wall 5B which extends in the midplane. The flat wall 5B forms a bottom of the protective shell 5. The flat wall 5B thus forms a second longitudinal end S of both the protective shell 5 and the base 8. The flat wall 5B also forms a second longitudinal end S for the cartridge 13 when the base and the cartridge 13 are coupled.

In addition, the base 8 comprises an operating member 6 resting on a face of the flat wall 5B facing the bottom element 4 when the base 8 and the cartridge 13 are detachably coupled. The operating member 6 has the function of making it possible to detachably couple the base 8 to the cartridge 13 as will be described in detail below. The operating member 6 also has the function of securing the base 8 and the bottom element 4 so that they are integral in rotation.

The operating member 6 defines a three-dimensional coded pattern which is presented here in the shape of a key. It thus comprises a seat 6A which extends in the midplane and which rests on the flat wall 5B. The operating member 6 further comprises a coupling stud 6B which projects from the seat 6A along the longitudinal axis X. The coupling stud 6B has a particular shape and contributes to giving the operating member 6 its key shape.

Figure 10:
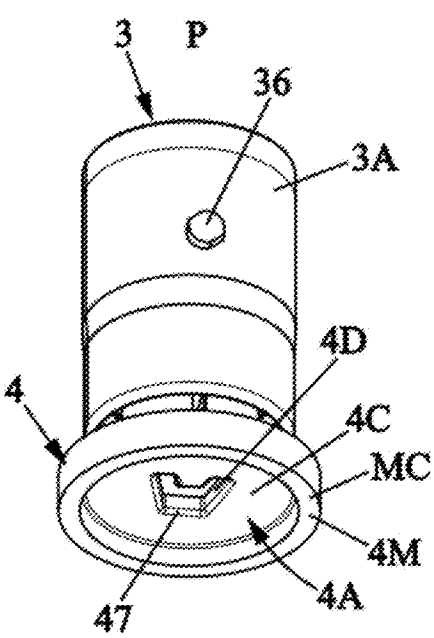
FIG. 10 illustrates a perspective view of a receptacle for cosmetic product, a bottom element, and the base, without a protective shell, for the dispensing device of the third embodiment.
Figure 11:
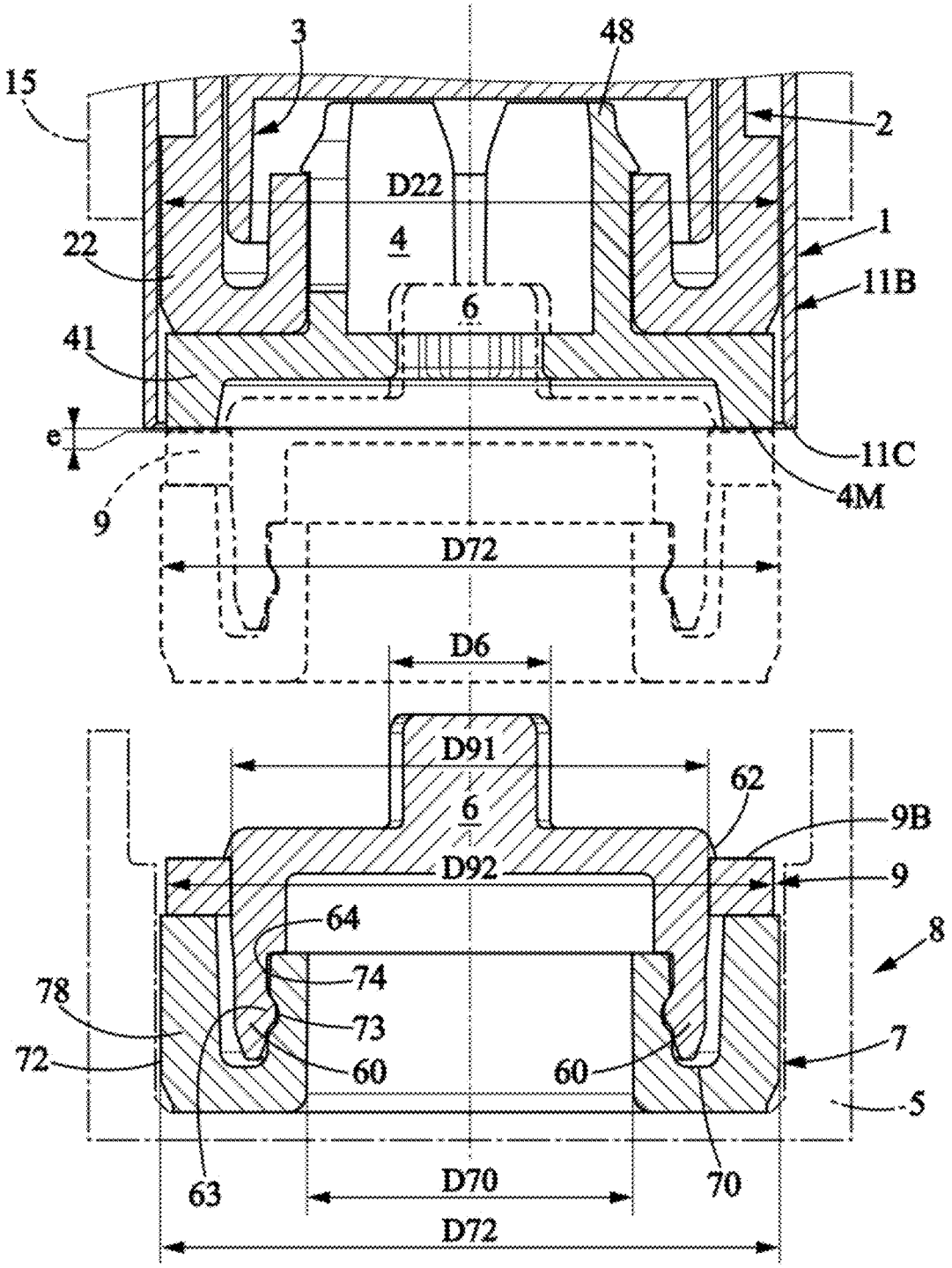
FIG. 11 illustrates more particularly the magnetic retention interface between the base and the cartridge, according to the third embodiment.

According to the two embodiments of the invention, the coupling stud 6B bears the coded pattern defining a particular "A" shape 67, illustrated in FIG. 10, when viewed longitudinally from above. Of course, in some variants, the particular shape 67 may be any type of shape and in particular a "C", "S", "Z" or even "X" shape.

According to the invention, it is advantageous for the three-dimensional coded pattern to define a particular shape that can be easily identified by the user, for example a letter shape as indicated above. The user thus can easily identify that a certain base 8 is suitable for coupling to a certain cartridge 13.

It will be noted that according to a variant, the operating member 6 comprises at least one coupling orifice and/or a coupling stud and/or a coupling groove which contribute to defining the particular shape 47.

The three-dimensional coded pattern and the counterpart three-dimensional coded pattern are each circumscribed within a cylinder having a diameter D6 of less than 8 mm, preferably less than 7 mm, and even more preferably within a cylinder having a diameter of less than 6 mm.

The axial thickness of the male three-dimensional coded pattern may be less than 4 mm, preferably in the range of 2 mm to 3 mm.

The three-dimensional coded pattern forms a male part and the counterpart three-dimensional coded pattern forms a female part. In a reversed arrangement, it is also possible to have the three-dimensional coded pattern form a female part and the counterpart three-dimensional coded pattern form a male part.

As an alternative to the pattern in the form of a letter of the alphabet, one can also have a plurality of small dots in the manner of 3D Braille reading patterns.

We can thus have four male or female dots or a combination thereof, arranged in a square.

We can also have a configuration with five dots arranged in a pentagon, six dots arranged in a hexagon, or even seven dots with a dot in the center and six dots in a hexagon circumscribed around it.

In addition, the operating member 6 comprises, circumferentially on a radial edge, a permanently magnetized element which here is in the form of a magnet MB. The magnet MB has a general ring shape and extends circumferentially around the longitudinal axis X on the radial peripheral edge of the operating member 6.

In this embodiment, the magnet MB essentially comprises iron, in particular in the form of ferrite, for example strontium ferrite or barium ferrite. In some variants, the magnet MB comprises an alloy of neodymium, iron, and boron, or an alloy of aluminum, nickel, and cobalt, or a polymer material which contains a powder comprising one of the materials or alloys described above.

In FIG. 11, the magnet MB is an annular magnet denoted 9 held in place by snap-fitting two plastic parts 6, 7.

In a typical example, the outside diameter D92 of the annular magnet MB is 16 mm. In a typical example, the inside diameter D91 of the annular magnet MB is 12 mm.

The thickness of the annular magnet 9 is between 1 mm and 2 mm.

The base 8 may in particular be made of injected plastic. The protective shell 5 and the coupling element 6 may come as one piece or be formed separately and assembled by gluing for example. The protective shell 5 and the operating member 6 are integral in rotation. In addition, the base 8 may have a circular, square, or even hexagonal cross-section.

As indicated above, the cartridge 13 comprises the outer tube 1, the control sleeve 2, the receptacle 3 for the stick of lipstick PC, and the bottom element 4.

Figure 8:
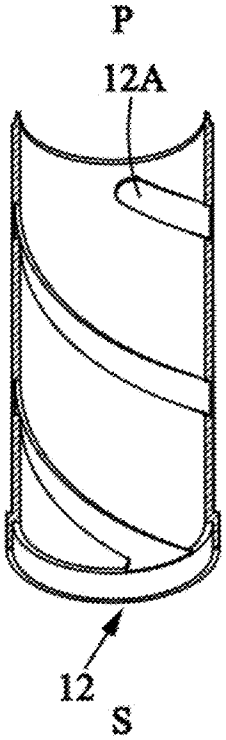
FIG. 8 represents a sectional view of a technical part for the outer tube.
Figure 7:
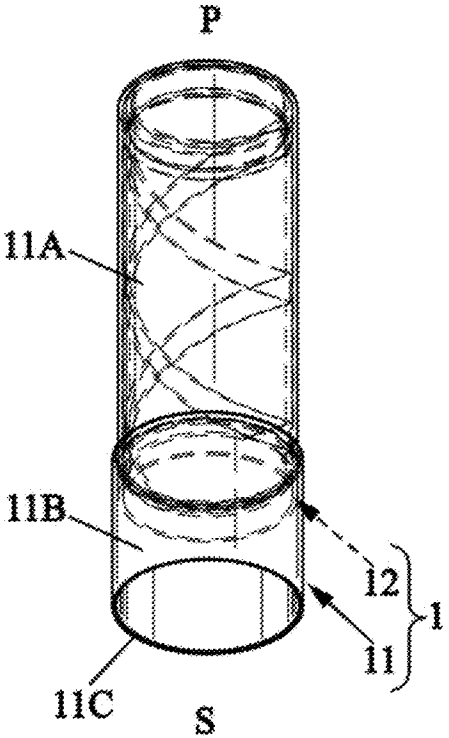
FIG. 7 represents a perspective view of a covering part for an outer tube of the cartridges according to a third embodiment.

The outer tube 1, also illustrated in FIGS. 7 and 8, has the function of forming an outer cylindrical wall for the cartridge 13. The outer tube 1 thus has a generally cylindrical shape of axis X. It has a first longitudinal end P intended to allow access to the stick of lipstick PC and an opposite second longitudinal end S. The first longitudinal end P of the outer tube 1 also forms a first longitudinal end P for the cartridge 13. In addition, the outer tube 1 extends substantially along the entire height of the cartridge 13. It thus forms a protective sheath for the cartridge 13.

As illustrated in FIGS. 7 and 8, the outer tube 1 comprises a covering part 11 which surrounds a technical part 12. The covering part 11 gives the outer tube 1 adequate structural reinforcement. The technical part 12 comprises, on an inner cylindrical face, two helical grooves 12A which extend along the longitudinal axis X of the cartridge 13. These two helical grooves 12A are arranged opposite one another and are thus diametrically opposite.

In addition, the outer tube 1 has a first cylindrical portion 1A and a second cylindrical portion 1B arranged following the first cylindrical portion 1A. The first cylindrical portion 1A is closer to the first longitudinal end P of the cartridge 13 than the second cylindrical portion 1B. The second cylindrical portion 1B has a diameter greater than the diameter of the first cylindrical portion 1A, for example 17 mm and 16 mm respectively for the outside diameters.

Thus, the cartridge 13 also has a first cylindrical portion and a second cylindrical portion arranged following the first cylindrical portion. The second cylindrical portion has a diameter greater than the diameter of the first cylindrical portion and comprises the bottom element 4 as illustrated in FIGS. 1 to 6.

Similarly, the covering part 11 has a first cylindrical portion 11A and a second cylindrical portion 11B arranged following the first cylindrical portion 11A. The first cylindrical portion 11A is closer to the first longitudinal end P of the outer tube 1 than the second cylindrical portion 11B. The second cylindrical portion 11B has a diameter greater than the diameter of the first cylindrical portion 11A.

One will note that the lower edge 11C of the outer tube forms an integral radial protection for the bottom element (skirt function). In other words, the bottom edge 11C extends down to the bottom and forms the overall lengthwise dimension of the cartridge. For the assembly, the technical part 12 is inserted into the covering part 11 from below, until it abuts against the inside shoulder (see FIG. 7).

The covering part 11 and the technical part 12 may be formed of metal or injected plastic. They may be fixed to each other by gluing. The covering part 11 and the technical part 12 may also come as one piece.

In addition, the outer tube 1 comprises, at its first longitudinal end P, a circumferential coupling edge 1C whose function will be described below.

Figure 9:
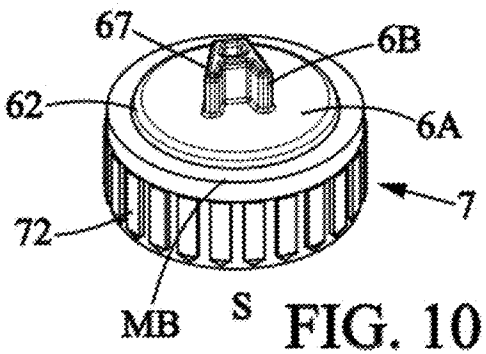
FIG. 9 represents a perspective view of a control sleeve for the cartridge according to the third embodiment of the invention.
Figure 9:
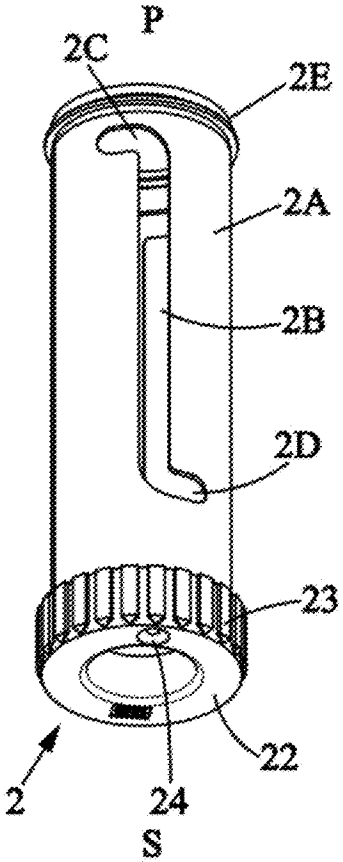

The control sleeve 2 also has a generally cylindrical shape. It is arranged against the inner cylindrical walls of the outer tube 1. As illustrated in FIG. 9, the control sleeve 2 comprises a main body 2A of regular generally cylindrical shape. On this main body 2A, the control sleeve 2 comprises two longitudinal guide slots 2B that are diametrically opposite through-slots. Each longitudinal guide slot 2B extends parallel to the longitudinal axis X. At its first P and second S longitudinal ends, each longitudinal guide slot 2B extends perpendicularly to the axis (X) for a small distance relative to its longitudinal dimension, so as to define two end-of-travel positions 2C, 2D for the receptacle 3 as will be described below. End-of-travel position 2C is relatively closer to the first longitudinal end P of the cartridge 13 than end-of-travel position 2D.

In addition, on the radial periphery of its first longitudinal end P, the main body 2A comprises a flange 2E. The function of the flange 2E will be described below.

In addition, the control sleeve 2 comprises a coupling member 22 arranged following the main body 2A, forming a second longitudinal end S of the control sleeve 2.

One will note that the coupling member 22 can be used to couple the control sleeve 2 to a base for a dispensing device in which the base and the cartridge are non-detachably coupled. To do this, the coupling member 22 comprises a cylindrical wall comprising a plurality of coupling grooves 23. In addition, the coupling member 22 comprises an orifice 24, on a wall facing the base when the base and the cartridge are coupled, due to the fact that the control sleeve 2 is formed by injection of a plastic material.

In the case of the present invention, the outer tube 1 and in particular the second cylindrical portion 11B of the covering part 11 surrounds this coupling member 22. Thus, advantageously, the dispensing device 10 according to the invention can be implemented with a control sleeve 2 that is also suitable for a dispensing device 10 in which the base and the cartridge are non-detachably coupled. Production of the dispensing device 10 is therefore simpler. In addition, the coupling member 22 also serves to couple the control sleeve 2 to the bottom element 4.

The receptacle 3 for the stick of lipstick PC here is in the form of a receiving cup. In addition, it comprises a main body 3A of regular generally cylindrical shape, in other words of constant diameter along the longitudinal axis X. As illustrated in FIG. 10, the receptacle 3 comprises, on an outer face of the main body 3A, two guide studs 36 which are diametrically opposite and which extend radially outward from the receptacle 3. The function of the two guide studs 36 will be described below. The receptacle 3 also preferably comprises injected plastic.

The bottom element 4 comprises an operating counterpart 4A, possibly in the form of a complementary operating member. The complementary operating member 4A comprises a complementary coded pattern (called "operating counterpart") which here has the shape of a lock.

The complementary operating member 4A comprises a first flat circumferential portion 4B which forms a stop for the operating member 6 as will be described in more detail below. The first flat portion 4B extends in the midplane.

The complementary operating member 4A comprises a second flat portion 4C which extends at a distance from flat portion 4B. The second flat portion 4C also extends in the midplane. The second flat portion 4C is closer to the first longitudinal end P of the cartridge 13 than the first flat portion 4B. In addition, the first flat portion 4B is further from the longitudinal axis X than the second flat portion 4C which intersects this longitudinal axis X.

The second flat portion 4C bears the complementary coded pattern which has a particular shape 47 and contributes to giving the complementary operating member the lock shape. This particular shape 47 represents an "A", as illustrated in FIG. 10, when viewed longitudinally from below. Of course, alternatively the particular shape 47 can have any type of shape and in particular a "C", "S", "Z", or even "X" shape.

Figure 2:
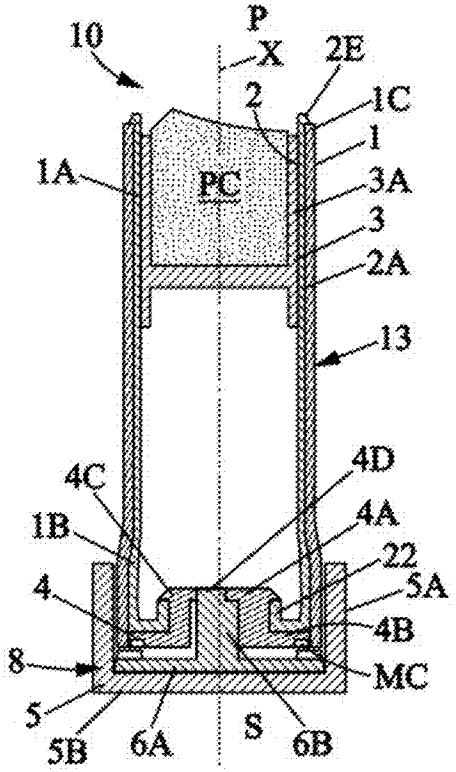
FIG. 2 illustrates this device in the same sectional plane, in which the receptacle for cosmetic product is in the raised position.

According to the first embodiment, the second flat portion 4C comprises in particular a coupling orifice 4D which defines the particular shape 47. Thus, according to the first embodiment, the bottom element 4 does not close off access to the interior of the cartridge 13 via the second longitudinal end S of the cartridge 13 as illustrated in FIG. 3. On the other hand, as illustrated in FIGS. 1 and 2, when the base 8 and the cartridge 13 are coupled, the base 8 closes off access to the interior of the cartridge 13 via the second longitudinal end S of the cartridge 13.

According to the second embodiment, the second flat portion 4C does not comprise an orifice. It comprises a stud 4D defining the contours of the particular shape 47. Thus, according to the second embodiment, the bottom element 4 closes off access to the interior of the cartridge 13 via the second longitudinal end S of the cartridge 13 as illustrated in particular in FIGS. 4 to 6.

According to one variant, the second flat portion 4C comprises at least one groove defining the particular shape 47. According to another variant, the particular shape 47 is defined by an assembly comprising a coupling orifice and/or a coupling stud and/or a coupling groove.

In addition, the first flat portion 4B and the second flat portion 4B are shaped to sandwich a portion of the coupling member 22 of the control sleeve 2.

According to the embodiments shown, the first means for coupling to the base 8 comprise a radial peripheral rim 4M of the bottom element 4.

In the examples illustrated in FIGS. 7 to 11, the radial peripheral rim 4M forms a magnetic coupling means and for this purpose is loaded with ferrites, in other words more generally a ferromagnetic material capable of being magnetized in an induced manner under the effect of an incident magnetic field.

More specifically, the ferromagnetic material is a material having a passive magnetic property, in other words a material which does not induce a permanent magnetic field under normal conditions but which is attracted by a magnet.

For example, particles of such a ferromagnetic material may be inserted into the plastic substrate to be molded.

For example, the plastic substrate to be molded is a thermoplastic material, such as polypropylene (PP), polyethylene terephthalate (PET), polyvinyl chloride (PVC), or any other polymer suitable for molding and/or injection. The passive magnetic particles may be, for example, iron particles, ferrite particles, or passivated ferric oxide particles.

According to an alternative solution illustrated in FIGS. 1 to 6, the first flat portion 4B comprises a permanently magnetized element which here is in the form of a magnet MC. The magnet MC has a general ring shape and extends circumferentially around the longitudinal axis X on one face of the first flat portion 4B opposite the seat 6A of the base 8 when the base 8 and the cartridge 13 are mated. In this embodiment, the magnet MC essentially comprises iron, particularly in the form of ferrite, for example strontium ferrite or barium ferrite. According to some variants, the magnet MC comprises an alloy of neodymium, iron, and boron, or an alloy of aluminum, nickel, and cobalt, or a polymer material which contains a powder comprising one of the materials or alloys described above. According to some variants, the magnet MC may be a part of ferromagnetic material which is magnetized by an incident magnetic field.

The magnet or ring of ferromagnetic material MC is arranged on a face of the bottom element 4 facing the flat wall 5B of the base 8 when the base 8 and the cartridge 13 are coupled.

At this location, the air gap in the coupled position will be less than 0.5 mm and preferably less than 0.2 mm. Knowing that the force of attraction between two elements under the action of a magnetic field decreases with the cube of the air gap distance, we will seek to obtain as small a space as possible and in practice we will seek to have the ring of ferromagnetic material NC directly in contact with the magnet 9, as shown in phantom lines in FIG. 11.

In the two embodiments, the outer tube 1 radially surrounds and extends longitudinally over the entire height of the bottom element 4. In the current case, the second cylindrical portion of the cartridge 13 comprises the bottom element 4. In addition, a radial edge of the bottom element 4 is in direct contact with a radially inner face of the outer tube 1. Thus, as can be seen in particular in FIGS. 1 to 6, the bottom element 4 forms, with the outer tube 1, the second longitudinal end S of the cartridge 13. One will note that in an advantageous variant, the bottom element 4 is arranged at a distance from and set back from the second longitudinal end S of the cartridge 13. The bottom element 4 is thus arranged between and at a distance from the first P and second S longitudinal ends of the outer tube 1.

We will now describe more precisely a detachable coupling between the base 8 and the cartridge 13.

As illustrated in FIGS. 1 to 6, the magnet MB of the base 8 and the magnet MC of the bottom element 4 are arranged facing one another when the base 8 and the cartridge 13 are detachably coupled. In addition, their facing sides have opposite polarities. They thus cooperate and generate a force that detachably couples the base 8 and the cartridge 13.

In addition, the key-shaped operating member 7B is capable of being engaged in the complementary lock-shaped operating member 4A of the bottom element 4. This engagement also contributes to securing the base 8 and the bottom element 4 so that they are integral in rotation about the longitudinal axis X.

According to a variant third embodiment, with particular reference to FIG. 11, the magnetic and mechanical interface between the base and the cartridge is shown in more detail in an uncoupled configuration (solid lines) and in a coupled configuration (dotted lines). The coupling element 6 is associated with a seat element 7 in order to attach a permanent magnet 9 by snap-fitting. The seat element 7 comprises an annular groove 70 which opens upwards and is designed to receive snap-fitting tabs 60 projecting downwards from the coupling element 6. The seat element 7 may be glued or fixed in the protective shell 5. The outer rim 78 of the seat element comprises ribs 72 engaged in the protective shell 5 in order to integrally secure it at least in rotation.

The snap-fitting tabs 60 comprise a bead 63 and an annular groove 64. The bead 63 is received in a complementary annular groove 73 of the seat element 7. The annular groove 64 receives a complementary bead 74 of the seat element 7. This forms a solid and durable snap-fit. Advantageously, a reliable and durable assembly is thus formed without the use of glue.

In addition, an upper annular edge 62 is provided which forms a shoulder to hold the element 9 in position against the outer rim 78 of the seat element 7. The upper annular edge 62 may be continuous or discontinuous in the circumferential direction.

The outside diameter D72 of the seat element is preferably within the range of values [15 mm-17 mm]. One will note that this diameter D72 is preferably advantageously identical to the diameter D22 of the coupling member of the control sleeve, which makes it possible to optimize the assembly means.

The inside diameter D70 of the seat element is preferably within the range of values [8 mm-12 mm].

If we consider the air gap denoted e which separates the upper surface 9B of the permanent magnet and the lower surface of the ferrite ring 4B of the bottom element, in the coupled configuration this is preferably less than 0.5 mm, or even close to zero.

In the example of FIG. 11, the rotational driving of the bottom element 4 by the coupling element 6 is obtained by the total or partial complementarity of the three-dimensional coded patterns coupled together.

We will now describe an operation of the dispensing device 10, in particular to access the stick of lipstick PC. Below we will describe in particular the movements of the members of the cartridge 13 with respect to each other.

The flange 2E of the control sleeve 2 has the function of engaging with the circumferential coupling edge 1C of the outer tube 1 as illustrated in FIGS. 1 to 6, in particular in order to lock the control sleeve 2 in translation along the longitudinal axis X relative to the outer tube 1. In addition, the control sleeve 2 is rotatable about the longitudinal axis X relative to the outer tube 1.

The bottom element 4 is integral in rotation about the longitudinal axis X with respect to the control sleeve 2. This property of being integral in rotation is in particular due to the engagement between the coupling member 22 of the control sleeve 2 and the first 4B and second 4C flat portions. Thus, when the base 8 and the cartridge 13 are detachably coupled, the base 8 and the control sleeve 2 are integral in rotation about the longitudinal axis X.

In addition, the receptacle 3 engages with the helical groove 12A of the outer tube 1 and the longitudinal guide slot 2B of the control sleeve 2. To achieve this, each of the two guide studs 36 of the receptacle 3 engages with one of the two longitudinal guide slots 2B of the control sleeve 2 and traverses said slot. The receptacle 3 is thus movable in longitudinal translation relative to the control sleeve 2, between the two end-of-travel positions 2C and 2D for the guide stud 36. In addition, each guide stud 36 engages with one of the two helical grooves 12A of the outer tube 1 when arranged within said groove. The receptacle 3 is thus movable in rotation about the axis X and in longitudinal translation relative to the outer tube 1.

When the control sleeve 2 begins to rotate relative to the outer tube 1 about the longitudinal axis X, each guide stud 36 of the receptacle 3 thus moves along a helical groove 12A and a longitudinal groove 2B. The receptacle 3 thus begins to rotate about the longitudinal axis X and to move in longitudinal translation relative to the outer tube 1.

Thus, when the user wishes to move the receptacle 3 longitudinally relative to the outer tube 1, for example to cause the stick of lipstick PC to project beyond the first longitudinal end P of the outer tube 1, he or she locks the outer tube 1 against longitudinal translation and rotation about the longitudinal axis X. Next, he or she imparts a rotational movement to the receiving shell 5, about the longitudinal axis X relative to the outer tube 1. The bottom element 4 and the control sleeve 2 thus begin to rotate about the longitudinal axis X relative to the outer tube 1. Each guide stud 36 of the receptacle 3 will then move along a helical groove 12A and a longitudinal guide slot 2B. The receptacle 3 thus moves longitudinally along the cartridge 13. It can therefore be seen that a relative rotation of the receiving shell 5 with respect to the cartridge 13 causes the receptacle 3 for the stick of lipstick PC to move with respect to the outer tube 1 along the longitudinal axis X of the cartridge 13.

Of course, many variations can be applied to the invention without departing from the scope thereof.

The base 8 may also comprise means for direct coupling to the control sleeve 2.

The coded pattern may in particular be defined by at least one pin and one hole, the complementary coded pattern thus being able to be defined by at least one pin and one hole arranged symmetrically.

The invention claimed is:

1. Cosmetic product (PC) dispensing device (10) comprising a base (8) and a tubular cartridge (13) configured to be detachably coupled to the base (8), the cartridge (13) comprising:

an outer tube (1) comprising at least one helical groove (12A), a control sleeve (2) comprising at least one longitudinal guide slot (2B), a receptacle (3) for cosmetic product (PC), engaging with the helical groove (12A) of the outer tube (1) and the longitudinal guide slot (2B) of the control sleeve (2), a bottom element (4), integral in rotation with the control sleeve (2), wherein the base (8) comprises an operating member (6) comprising a three-dimensional coded pattern (6B, 67) and the bottom element (4) comprises an operating counterpart (4A) comprising a counterpart three-dimensional coded pattern (47) such that the operating member (6) is able to be coupled with the operating counterpart (4A) so that a relative rotation of the base (8) in relation to the cartridge (13) causes a movement of the receptacle (3) for cosmetic product (PC) along a longitudinal axis (X) of the cartridge (13), the bottom element comprising a ring of ferromagnetic material (4M) or a magnet and the base (8) comprising a permanent magnet (9, MB) or an associated ring of ferromagnetic material and configured to contribute to providing a retention force between the cartridge and the base when the cartridge is coupled to the base, and the bottom element being covered radially outward by the outer tube, and wherein the base (8) comprises a seat element (7) which engages with the operating member (6) to attach by snap-fitting the permanent magnet (9, MB) or the ring of ferromagnetic material of the base (8).

2. The cosmetic product dispensing device (10) according to claim 1, wherein the operating counterpart (4A) comprises a portion (4C) having at least one coupling groove and/or at least one coupling orifice and/or at least one coupling stud.

3. The cosmetic product (PC) dispensing device (10) according to claim 1, wherein the cosmetic product (PC) is a stick of lipstick.

4. The cosmetic product dispensing device (10) according to claim 1, wherein an outside diameter (D72) of the seat element (7) is within the range of 15 mm-17 mm.

5. The cosmetic product dispensing device (10) according to claim 1, wherein an inside diameter (D70) of the seat element (7) is within the range of 8 mm-12 mm.

6. The cosmetic product dispensing device (10) according to claim 1, wherein, in a configuration where the cartridge is assembled on the base, an interval representing an air gap (e) which separates an upper surface (9B) of the permanent magnet (9, MB) or a ring of ferromagnetic material of the base (8) and a lower surface of the ring of ferromagnetic material (4M) or of the magnet of the bottom element (4) is less than 0.5 mm.

7. The cosmetic product dispensing device (10) according to claim 1, wherein, in a configuration where the cartridge is assembled on the base, a rotational driving of the bottom element (4) by the operating member (6) is obtained by:

striations (66) of the operating member (6) are received in complementary striations (42) of the bottom element (4), or an area of friction between the ring of ferromagnetic material (4M) or the magnet of the bottom element (4), and the permanent magnet (9, MB) or the associated ring of ferromagnetic material of the base (8).

8. The cosmetic product dispensing device (10) according to claim 1, wherein the three-dimensional coded pattern (67) forms a male part and the counterpart three-dimensional coded pattern (47) forms a female part.

9. The cosmetic product dispensing device (10) according to claim 8, wherein the three-dimensional coded pattern of the operating member (6) has a key shape (67), the counterpart three-dimensional coded pattern of the operating counterpart (4A) having a lock shape (47).

10. The cosmetic product dispensing device (10) according to claim 1, wherein the seat element (7) is glued or fixed in a protective shell (5) forming an outer wall of the base (8).

11. The cosmetic product dispensing device (10) according to claim 10, wherein the three-dimensional coded pattern (67) forms a male part and the counterpart three-dimensional coded pattern (47) forms a female part.

12. The cosmetic product dispensing device (10) according to claim 10, wherein the seat element comprises an outer rim (78) having ribs (72) engaged in the protective shell (5) in order to integrally secure it at least in rotation.

13. The cosmetic product dispensing device (10) according to claim 12, wherein the three-dimensional coded pattern (67) forms a male part and the counterpart three-dimensional coded pattern (47) forms a female part.

14. The cosmetic product dispensing device (10) according to claim 1, wherein the three-dimensional coded pattern (67) and the counterpart three-dimensional coded pattern (47) are each circumscribed within a cylinder having a diameter (D6) of less than 8 mm.

15. The cosmetic product dispensing device (10) according to claim 14, wherein the three-dimensional coded pattern (67) forms a male part and the counterpart three-dimensional coded pattern (47) forms a female part.

16. The cosmetic product dispensing device (10) according to claim 14, wherein the seat element (7) comprises an annular groove (70) which opens upwards and is designed to receive snap-fitting tabs (60) projecting downwards from the operating member (6).

17. The cosmetic product dispensing device (10) according to claim 16, wherein the three-dimensional coded pattern (67) forms a male part and the counterpart three-dimensional coded pattern (47) forms a female part.

18. The cosmetic product dispensing device (10) according to claim 16, wherein the snap-fitting tabs (60) comprise a bead (63) and an annular groove (64), the bead (63) being received in a complementary annular groove (73) of the seat element (7), the annular groove (64) receiving a complementary bead (74) of the seat element (7).

19. The cosmetic product dispensing device (10) according to claim 18, further comprising an upper annular edge (62) forming a shoulder to hold the permanent magnet (9, MB) or the ring of ferromagnetic material of the base (8) in position against an outer rim (78) of the seat element (7).

20. The cosmetic product dispensing device (10) according to claim 18, wherein the three-dimensional coded pattern (67) forms a male part and the counterpart three-dimensional coded pattern (47) forms a female part.

* * * * *